United States Patent [19]

Richardson et al.

[11] 4,010,542

[45] Mar. 8, 1977

[54] PLASTIC SCORING TOOL

[75] Inventors: Philip E. Richardson, West Hartford; Lothar Lenhardt, Manchester, both of Conn.

[73] Assignee: The Fletcher-Terry Company, Farmington, Conn.

[22] Filed: June 27, 1975

[21] Appl. No.: 591,173

[52] U.S. Cl. ..... 30/164.9; 30/317

[51] Int. Cl.[2] ..... B26B 3/00

[58] Field of Search ..... 30/366, 358, 368, 164.9, 30/294, 317, 314, 315

[56] References Cited

UNITED STATES PATENTS

| | | | |
|---|---|---|---|
| 322,755 | 7/1885 | Seaman | 30/294 |
| 1,057,857 | 4/1913 | Leidich | 30/315 |
| 1,380,008 | 5/1921 | Otto | 30/294 |
| 1,775,380 | 9/1930 | Wilson | 30/164.9 |
| 2,297,684 | 10/1942 | Bratcher et al. | 30/164.9 |
| 2,670,535 | 3/1954 | Ogden | 30/314 |
| 2,847,758 | 8/1958 | Kozan | 30/164.9 |
| 3,324,548 | 6/1967 | Mascia | 30/294 |
| 3,337,951 | 8/1967 | White | 30/164.9 |
| 3,355,804 | 12/1967 | Rothe | 30/317 |
| 3,601,893 | 8/1971 | Knox | 30/164.9 |

*Primary Examiner*—Al Lawrence Smith
*Assistant Examiner*—J. T. Zatarga
*Attorney, Agent, or Firm*—McCormick, Paulding & Huber

[57] ABSTRACT

A flat spring steel element has a handle portion, an offset shank portion, and a blade portion defining a symmetrically ground chisel edge. The edge is oriented at 45° to the handle axis and each end of the chisel edge is ground to define two scoring tips. One of these tips has a 15° forward rake angle when the tool handle is held perpendicular the surface to be scored, and the other tip has a similar rake angle when the tool handle is held at a slightly inclined position relative to such surface.

2 Claims, 5 Drawing Figures

16a
16
20
10
H
40°
18
18a
18b
18c
18d
14
12
22
P
d
C
2
4
5

PLASTIC SCORING TOOL

SUMMARY OF INVENTION

This invention relates generally to tools for scoring fracture sensitive plastic sheet material, and deals more particularly with a tool having two scoring tips, each of which tips is conveniently usable without having to reposition the blade in the handle. The two tips are defined at opposed ends of a straight chisel edge blade portion of the tool provided at the end of an offset shank portion, the latter being integrally connected to both the blade and the handle portions.

The unique construction permits a single flat spring steel element to define both scoring tips and the handle as well as the structure therebetween, and these tips are so related geometrically that one tip can conveniently be used to score the plastic sheet when the handle is held perpendicular to the surface to be scored. Alternatively, the other tip is conveniently usable when the handle is held at a slight angle with respect to such sheet surface.

DETAILED DESCRIPTION

Figures 1, 2, 3, 4, 5:
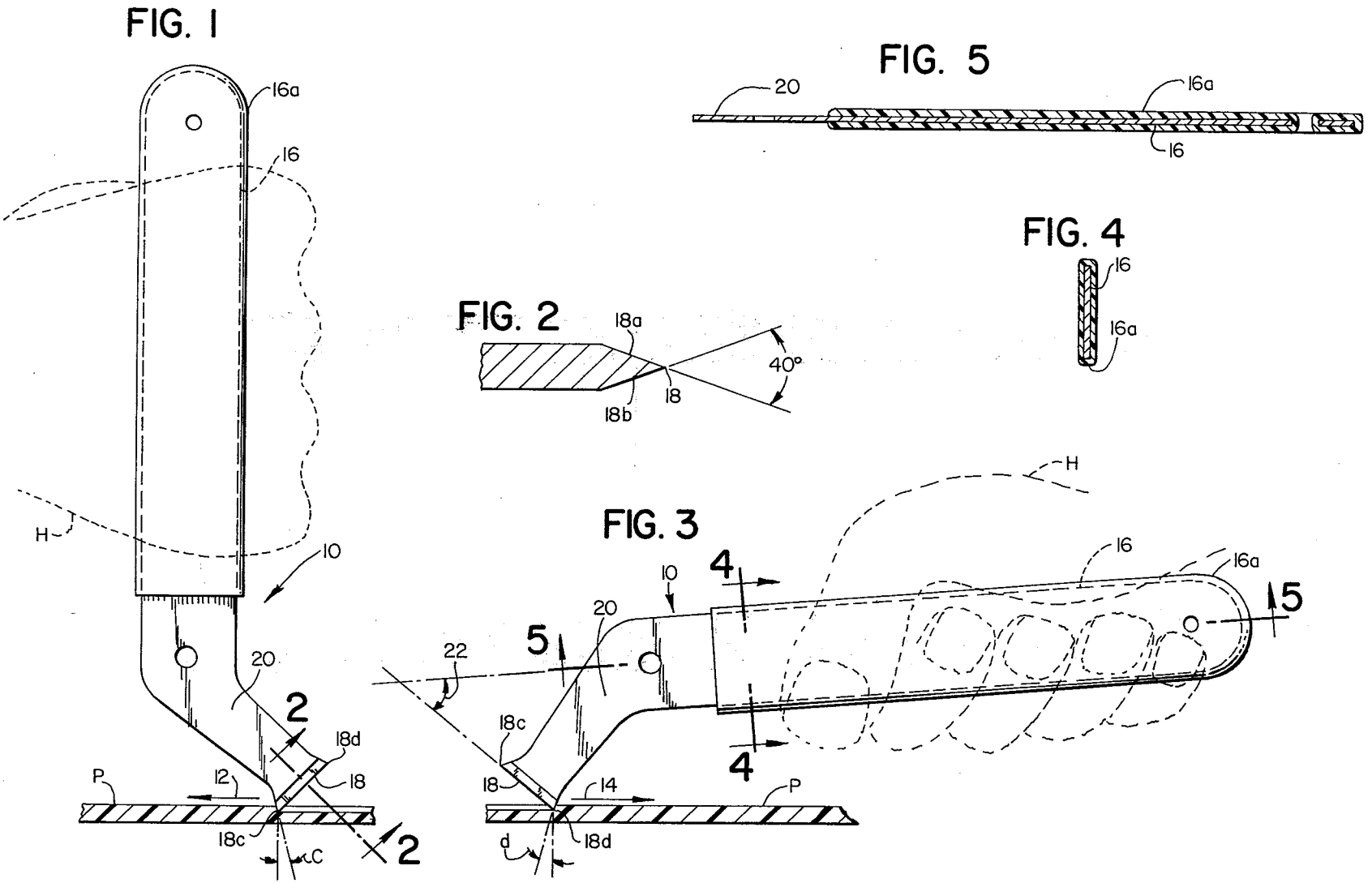
FIG. 1 is a side elevational view illustrating the handle in a position generally perpendicular the plastic sheet being scored.
FIG. 2 is a sectional view taken generally on the line 2—2 of FIG. 1.
FIG. 3 is a side elevational view of the tool depicted in FIG. 1, but with the handle portion being held at a slight inclination with respect to the surface of the sheet being scored.
FIG. 4 is a sectional view taken generally on the line 4—4 of FIG. 3.
FIG. 5 is a sectional view taken generally on the line 5—5 of FIG. 3.

Turning now to the drawing in greater detail, FIGS. 1 and 3 show the same scoring tool 10 held in two distinctly different positions, respectively, both of which positions permit one or the other of two distinct scoring tips defined in the tool to be used in order to score a plastic sheet P. In FIG. 1 the tool 10 is drawn toward the left so that the tool moves in the direction of the arrow 12, the handle portion of the tool being held generally perpendicular to the surface of the plastic P as the user's hand H manually draws the tool across the plastic sheet P. It will be apparent that a straight edge or other guiding device might be utilized in order to perform this scoring operation, but such conventional tooling has been eliminated for clarity in the drawing. In FIG. 3, the user's hand H is adapted to pull the scoring tool 10 so that the other scoring tip defined in the tool scores the plastic sheet P as the tool is drawn in the direction of the arrow 14.

Basically, and as best illustrated in FIG. 5, the tool comprises a generally flat spring steel plate or element, which element has a handle portion indicated generally at 16, and which handle portion 16 may be covered with a vinyl material as indicated generally at 16*a*. The thickness of the flat spring steel element is preferably on the order of 1/16 of an inch, and may comprise 1075 type heat treatable steel or the equivalent. It is an important feature of the present invention that the scoring tips are defined by projecting portions of this spring steel element, and that these scoring tips are defined at opposed ends of a short linear segment, or chisel edge of the tool indicated generally at 18. This chisel is defined at the blade end portion of the tool, and it is a further feature of the present invention that this blade portion is integrally connected to the handle portion of the spring steel element by an intermediate shank portion.

The shank portion serves to offset the chisel edge at approximately 45° with respect to the longitudinal axis of the handle portion 16, as indicated generally by the angle shown in FIG. 3 at reference numeral 22. Thus, the chisel edge 18 is canted with respect to the handle portion 16, and is offset with respect thereto as a result of the configuration of the shank 20. This offset configuration not only provides a castering action when the tool is utilized as shown in FIG. 1, but this offset also serves to provide clearance between the plastic sheet P and the user's hand H, and more particularly the fingers of his hand when the tool is drawn across the sheet as depicted in FIG. 3.

The angle 22 is preferably provided in the range between 30° and 60° and is more particularly on the order of approximately 45° for best results.

Considering next the configuration of the blade portion of the tool in greater detail, FIG. 2 shows the chisel edge 18 in sectional view as being defined by ground surfaces 18*a* and 18*b* which define an included angle of 40° therebetween, and which are ground symmetrically with respect to the opposed faces of the generally flat spring steel element. It is an important feature of the present invention that the opposed ends of the chisel edge 18, indicated at 18*c* and 18*d*, are so ground so as to define two tips for the tool, the tip *c* being defined by its associated end face oriented at a 15° forward rake angle with respect to a normal or perpendicular reference line drawn to the surface to be scored when the handle portion 16 is itself normal to such surface, as shown in FIG. 1.

When the other scoring tip *d* is utilized, as shown in FIG. 3, said tip *d* is defined by the opposed end face of the blade portion, which face is also oriented at a 15° forward rake angle when the handle 16 is held at a slight inclination with respect to the surface to be scored. These forward rake angles are depicted schematically in FIGS. 1 and 3 respectively being indicated generally by the reference letters *c* and *d* of these views.

As a result of the above described geometry for the blade portion of the tool shown in the drawing, the advantages to a two tipped plastic scoring device are obtained without the necessity for removal and replacement of the blade in a complex handle construction. Each of the tips will present an angle of 15° leading into the direction of cut, or a forward rake angle, as a result of this unique geometry. In the fabrication of a tool incorporating the present invention the critical 40° angle between the ground surfaces 18*a* and 18*b*, which serve to define the chisel edge 18, may be simultaneously formed in a single operation with the result that two tips are fabricated, virtually at once, rather than requiring a further machining step in order to provide two distinct scoring tips in a single plastic scoring tool. The offset shank portion 20 contributes to the improved results achieved as a result of the geometry described above, and more particularly so that each of the tips is designed to trail the line of action of the gripping hand H when the tool is held either vertically, or generally horizontally, as shown in FIGS. 1 and 3 respectively. This castering action permits easy guidance of the scoring tool along a straight edge or other guiding device (not shown). Further, this offset shank portion 20 permits the handle to be held at the desired height above the surface of the plastic sheet being scored so that the knuckles of the hand do not scrape along the sheet or edge guide.

We claim:

1. A tool for scoring plastic sheet material by hand, said tool having a flat handle with a longitudinal axis adapted to be held at a small angle to the sheet surface to be scored and also adapted to be held generally normal to the surface of the sheet to be scored, a flat blade having a straight chisel edge with two alternately usable scoring tips defined at opposite ends of said chisel edge, said edge being V-shaped and defined by ground surfaces 18*a* and 18*b*, said V-shaped chisel edge oriented at an angle of approximately 45° with respect to said handle axis and being offset with respect thereto, said blade and handle integrally connected to one another by an intermediate flat shank portion providing said offset such that said alternately useable tips have a castering action when the handle is so held, said handle, said blade and said intermediate shank portion being coplanar, and both tips defined in part by said ground surfaces 18*a* and 18*b* and also defined in part by ground end faces 18*c* and 18*d* at opposite ends of said chisel edge, each of said ground end faces oriented at an angle such that a 15° forward rake angle (c or d) with respect to a normal reference line drawn to said sheet surface is provided for the tips when the handle is so held to score plastic sheet material.

2. The tool according to claim 1 wherein said handle, intermediate shank and blade are formed from flat steel bar stock of constant thickness, portion said handle having a vinyl sleeve.

* * * * *

UNITED STATES PATENT OFFICE

CERTIFICATE OF CORRECTION

Patent No. 4,010,542 Dated March 8, 1977

Inventor(s) Philip E. Richardson and Lothar Lenhardt

It is certified that error appears in the above-identified patent and that said Letters Patent are hereby corrected as shown below:

Col. 4, line 15, after "shank" insert --portion--.

Col. 4, line 16, after "thickness" delete --portion--.

Signed and Sealed this

Tenth Day of May 1977

[SEAL]

*Attest:*

RUTH C. MASON
*Attesting Officer*

C. MARSHALL DANN
*Commissioner of Patents and Trademarks*